US005829416A

United States Patent [19]

Teraoka et al.

[11] Patent Number: 5,829,416

[45] Date of Patent: Nov. 3, 1998

[54] FUEL-VAPOR TREATING APPARATUS

[75] Inventors: Katsuhiko Teraoka, Toyota; Masashi Miyamaru, Nagoya, both of Japan

[73] Assignee: Toyota Jidosha Kabushiki Kaisha, Toyota, Japan

[21] Appl. No.: 856,613

[22] Filed: May 15, 1997

[30] Foreign Application Priority Data

May 17, 1996 [JP] Japan ..... 8-123502

[51] Int. Cl.[6] ..... F02M 33/02

[52] U.S. Cl. ..... 123/520

[58] Field of Search ..... 123/516, 518, 123/519, 520

[56] References Cited

U.S. PATENT DOCUMENTS

| | | | |
|---|---|---|---|
| 5,295,472 | 3/1994 | Otsuka et al. | 123/520 |
| 5,623,911 | 4/1997 | Kiyomiya et al. | 123/520 |
| 5,632,251 | 5/1997 | Ishikawa | 123/519 |
| 5,653,211 | 8/1997 | Ishikawa | 123/520 |

*Primary Examiner*—Thomas N. Moulis
*Attorney, Agent, or Firm*—Burns, Doane, Swecker & Mathis, LLP

[57] ABSTRACT

An apparatus for treating fuel vapor from a fuel tank. The apparatus includes a canister for collecting the fuel vapor generated in the fuel tank through a vapor line, a purge line for purging the collected fuel in the canister into an intake passage, and a control valve disposed midway on the purge line. The fuel tank, the canister, the vapor line and the purge line are connectable to one another to define a closed space. A testing device, which is separately provided from the apparatus, tests the sealing of the closed space after the pressure for the testing is introduced into the closed space from the testing device. The apparatus includes an atmospheric valve for connecting the canister with the atmosphere. The atmospheric valve has a diaphragm and a first and a second pressure chambers. The pressure in the canister is introduced into the first pressure chamber. The second pressure chamber has a first pressure port. The purge line has a second pressure port defined between the canister and the control valve. A pipe connects the first pressure port with the second pressure port. The pipe has a single introduction port. The introduction port communicates with the atmosphere when the test is not performed and is connected to the testing device when the test is performed. A check valve is located in the pipe between the introduction port and the second pressure port. The check valve allows the pressure for the testing introduced from the introduction port to be supplied to the second pressure port and prevents the pressure acting on the second pressure port from being released through the introduction port.

13 Claims, 3 Drawing Sheets

FUEL-VAPOR TREATING APPARATUS

BACKGROUND OF THE INVENTION

1. Field of the Invention

The present invention relates generally to an apparatus for collecting vaporized fuel in a fuel tank and supplying the collected fuel to an intake passage of an engine. More particularly, the present invention pertains to an apparatus that includes a structure suitable for testing the sealing of the apparatus.

2. Description of the Related Art

Vehicles are typically provided with a fuel-vapor treating apparatus. The apparatus includes a canister that collects fuel-vapor from a fuel tank and prevents the fuel-vapor from being released into the atmosphere. When is necessary, the fuel-vapor is supplied to an intake passage of the engine.

In this type of fuel-vapor treating apparatus, damage in the canister or the fuel tank such as minute punctures may unseal the treating apparatus. This affects the sealing effectiveness of the apparatus, and may prevent fuel-vapor from being collected by the canister. Such degraded sealing of the apparatus also prevents the collected fuel-vapor from being adequately supplied to the intake passage of the engine.

Japanese Unexamined Patent Publication No. 4-362264 describes a fuel-vapor treating apparatus that includes malfunction detector for detecting such malfunctions. As shown in FIG. 4, the fuel-vapor treating apparatus includes a fuel tank 61, a canister 62, a vapor line 63, and a purge line 64. Fuel that vaporizes in the fuel tank 61 is drawn into the canister 62 through the vapor line 63. The canister 62 contains an adsorbent 62*a* to adsorb the fuel vapor. A port 62*b* communicated with the atmosphere is provided in the canister 62. The port 62*b* releases the pressure in the canister 62 when the pressure is high, and communicates the atmospheric pressure to the canister 62 when the pressure in the canister 62 is low. A first vacuum switching valve (VSV) 65 is connected to the port 62*b* for selectively opening and closing the port 62*b*. The purge line 64 extends from the canister 62 and is connected to an intake passage 66 of the engine. A second VSV 67 is arranged in the purge line 64 to selectively open and close the line 64. An electronic control unit (ECU) 68 is connected to the fuel-vapor treating apparatus. The ECU 68 opens the second VSV 67 when the engine is running. This causes the fuel collected and temporarily reserved in the canister 62 to be supplied into the intake passage 66 by the difference between the pressure in the passage 66 and the pressure in the canister 62.

The malfunction detector includes a pressure sensor 69 located in the vapor line 63. In order to detect malfunctions, the ECU 68 closes the first VSV 65 and momentarily opens the second VSV 67. This communicates negative pressure in the intake passage 66 to the space defined by the canister 62, the vapor line 63 and the tank 61 via the purge line 64. The ECU 68 then closes the second VSV 67 for a predetermined length of time, thereby sealing the space. While the space is sealed, the ECU 68 performs a test for seal malfunctions of the fuel-vapor treating apparatus based on pressure changes detected by the pressure sensor 69.

When performing the test, the port 62*b* is closed by the first VSV 65 for sealing the space defined in the apparatus. The vsv 65 is normally open and is closed only for the test. In other words, the VSV 65 is provided solely for testing for sealing malfunctions. This undesirably increases the cost of the apparatus. Further, the VSV 65 adds to the maintenance burden.

It is known in the art that the atmospheric port 62*b* has two check valves. The check valves function as atmospheric valves. One of the atmospheric valves is opened when the pressure in the canister 62 falls to a predetermined negative pressure for communicating the atmospheric pressure to the canister 62. The other atmospheric valve is opened when the pressure in the canister 62 reaches a predetermined pressure, which is higher than the atmospheric pressure for releasing the pressure in the canister 62. Providing the atmospheric port 62*b* with the two atmospheric valves enables the port 62*b* to be closed.

The malfunction detector of the above publication is controlled by the ECU 68. Therefore, when the ECU 68 is not operating, the testing cannot be performed. Sealing malfunction of a fuel-vapor treating apparatus may be detected by a more simplified method without using the ECU 68. In this method, a space defined in the apparatus is temporarily sealed and positive or negative pressure is communicated to the sealed space. Pressure changes in the sealed space are monitored for detecting sealing malfunctions of the apparatus.

However, in order to perform such a simplified testing method on the above apparatus, which has two atmospheric valves in the atmospheric port 62*b* of the canister 62, the apparatus must have the following structure. Firstly, the apparatus must be provided with an additional port for communicating positive or negative pressure to the sealed space in the apparatus. Secondly, the atmospheric valves must be kept closed when the positive or negative pressure is applied to the closed space in the apparatus for the testing. As described above, the atmospheric valves open in accordance with pressure changes in the canister 62. However, if the atmospheric valves always open in accordance with the pressure in the canister 62, the space in the apparatus cannot be sealed for the testing. Testing for sealing malfunctions is therefore impossible.

SUMMARY OF THE INVENTION

Accordingly, it is an objective of the present invention to provide a fuel-vapor treating apparatus the structure of which is suitable for testing the sealing of the apparatus.

To achieve the above objective, the present invention discloses an apparatus for treating fuel vapor from a fuel tank. The fuel tank stores fuel to be supplied to an intake passage of an engine. The apparatus includes a canister for collecting the fuel vapor generated in the fuel tank through a vapor line, a purge line for purging the collected fuel in the canister into the intake passage by a negative intake pressure generated in the intake passage during operation of the engine, and a control valve disposed midway on the purge line to selectively open and close the purge line. The fuel tank, the canister, the vapor line and the purge line are connectable to one another to define a closed space. The sealing of the closed space is tested based on varying of the pressure in the closed space after the pressure for the testing is introduced into the closed space. The apparatus includes an atmospheric valve for connecting the canister with the atmosphere based on the varying of the pressure in the canister. The atmospheric valve has a diaphragm and a first and a second pressure chambers separated by the diaphragm. The pressure in the canister is introduced into the first pressure chamber. The second pressure chamber has a first pressure port communicating with the atmosphere. The purge line has a second pressure port defined between the canister and the control valve. The second pressure port is capable of being open solely during the testing the sealing of the closed space. The pressure for the testing is introduced from the first pressure port and the second pressure port when the test is performed.

Other aspects and advantages of the invention will become apparent from the following description, taken in conjunction with the accompanying drawings, illustrating by way of example the principals of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

An embodiment of a fuel vapor treating apparatus for a vehicle according to the present invention will hereafter be described with reference to FIGS. 1 to 3.

Figure 1:
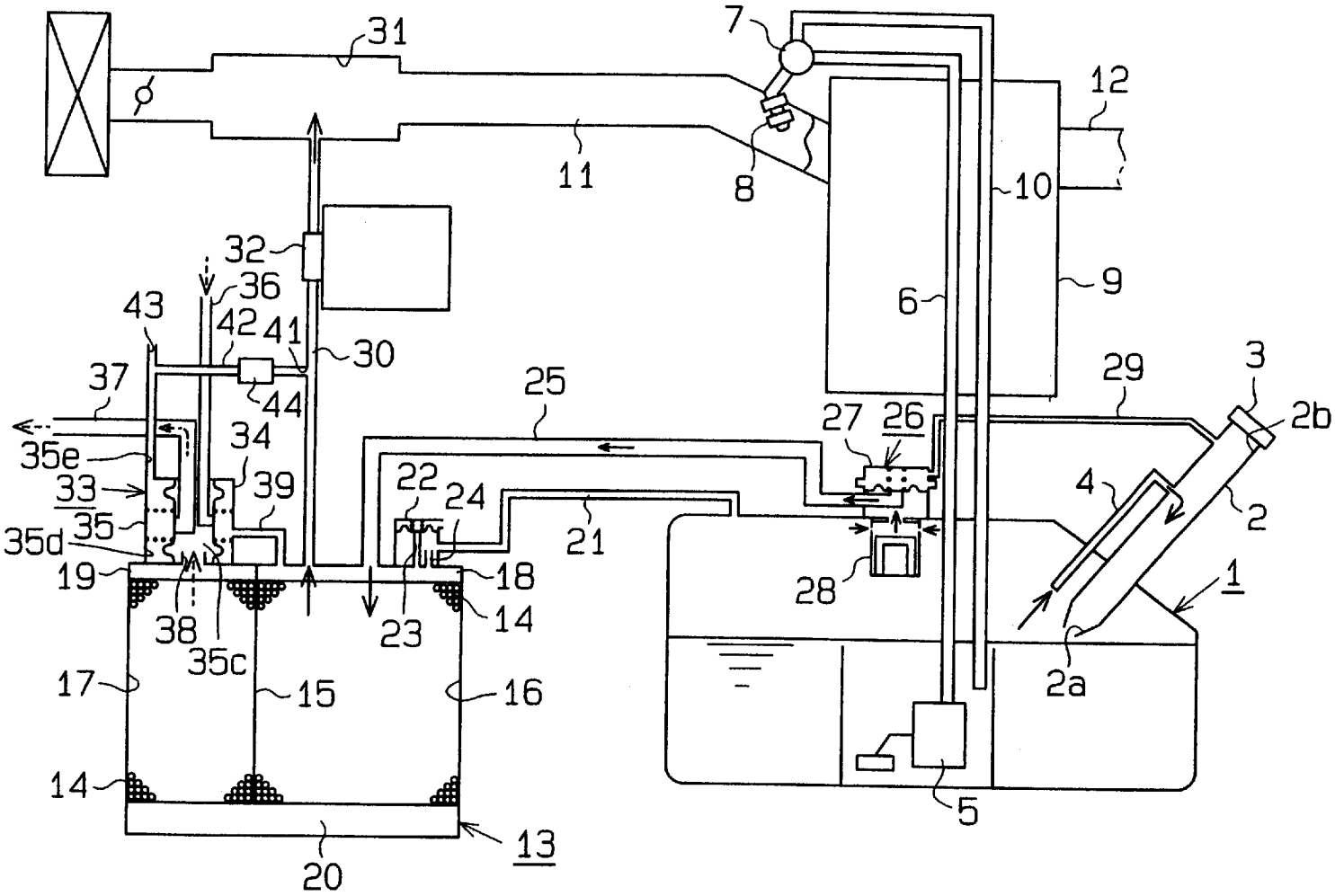
FIG. 1 is a diagrammatic cross-sectional view showing the structure of a fuel vapor treating apparatus according to one embodiment of the present invention.

Referring to FIG. 1, a gasoline engine system of a vehicle has a fuel tank 1 in which fuel is reserved. The tank 1 includes a filler pipe 2 for filling the tank 1 with fuel. A restriction 2*a* is defined at the lower end of the filler pipe 2. The pipe 2 has a filler hole 2*b* into which a fuel nozzle (not shown) is inserted during refueling of the tank 1. The filler hole 2*b* is closed by a removable cap 3. A thin pipe 4 communicates the interior of the tank 1 with the middle portion of the filler pipe 2.

The fuel inside the tank 1 is drawn into a pump 5, incorporated in the tank 1, and discharged therefrom. A main line 6 extending from the pump 5 is connected to a delivery pipe 7. A plurality of injectors 8, provided in the pipe 7, are aligned with cylinders of an engine 9. A return line 10 extending from the pipe 7 is connected to the tank 1. Operation of the pump 5 causes the fuel discharged from the pump 5 to be sent to the delivery pipe 7 via the main line 6. The delivery pipe 7 distributes fuel to each injector 8. As each injector 8 is actuated, the fuel is injected into an intake passage 11. The fuel, injected from the injectors 8, is mixed with air and supplied to each cylinder of the engine 9 for combustion. The residual fuel that is not distributed to the injectors 8 is returned to the tank 1 via the return line 10. The exhaust gas produced during combustion is emitted into the atmosphere from the cylinders of the engine 9 through an exhaust passage 12.

The fuel vapor treating apparatus has a canister 13 to adsorb and collect vaporized fuel from the tank 1. As shown in FIGS. 1 and 2, the canister 13 is filled with an adsorbent 14 comprised of activated carbon or the like. Fuel-vapor from the tank 1 is adsorbed by the adsorbent 14. The canister 13 includes a dividing plate 15 that is vertically placed therein. The plate 15 defines first and second chambers 16, 17. Both chambers 16, 17 are filled with the adsorbent 14. The top portion of the chambers 16, 17 and the adsorbent define first and second spaces 18 and 19, respectively. Further, a third space, which is defined in the bottom portion of the canister 13, communicates the first and second chambers 18 and 19 with each other.

The canister 13 is communicated with the tank 1 by a vapor line 21. The vapor line 21 draws fuel-vapor in the tank 1 to the canister 13. A vapor control valve 22 is connected to the first space 18 of the canister 13. One end of the vapor line 21 is connected to the vapor control valve 22. The valve 22 opens when the internal pressure of the tank 1 reaches a predetermined pressure for drawing fuel-vapor in the tank 1 into the canister 13. The valve 22 regulates an inlet port 23 protruding from the canister 13. As shown in FIG. 2, the valve 22 includes a diaphragm 22*b* contacting the inlet port 23. The diaphragm 22*b* defines an atmospheric chamber 22*c* in the upper portion of the valve 22 and a pressure chamber 22*d* in the lower portion of the valve 22. A spring 22*a* extends in the atmospheric chamber 22*c*. The spring 22*a* urges the diaphragm 22*b* toward the port 23, thereby closing the port 23. The atmospheric chamber 22*c* is communicated with the atmosphere by an atmospheric port 22*e*. One end of the vapor line 21 is connected to the pressure chamber 22*d*. A relief valve 24, which is a ball type check valve, is located next to the inlet port 23 in the pressure chamber 22*d*. The relief valve 24 allows air flow from the canister 13 to the vapor line 21 and blocks air flow in the reverse direction.

When the internal pressure of the tank 1 reaches a predetermined pressure that is higher than the atmospheric pressure, the pressure acts on the pressure chamber 22*d* through the vapor line 21 and pushes the diaphragm 22*b* upward against the force of the spring 22*a*. This opens the inlet port 23, thereby allowing the fuel-vapor in the tank 1 to flow in the canister 13 via the vapor line 21. Contrarily, when the internal pressure of the tank 1 is lower than that of the canister 13, the relief valve 24 is opened. This allows air flow from the canister 13 to the vapor line 21.

The fuel in the tank 1 is vaporized when the vehicle is driven and when it is parked; that is, when the engine 9 is running or stopped. The vapor line 21 is employed to draw the fuel-vapor in the tank 1 to the canister 13. When not refueling, the amount of vaporized fuel is relatively small and the change in its amount is gradual. Thus, the cross-sectional area of the vapor line 21 is relatively small. However, a large amount of fuel vapor is generated during refueling. Therefore, a large amount of fuel vapor must be collected by the canister 13 without emitting the vapor into the atmosphere from the filler hole 2*b* during refueling.

To fulfill this requirement, the treating apparatus of FIG. 1 has a breather line 25 in addition to the vapor line 21. The breather line 25 connects the tank 1 to the canister 13. The breather line 25 readily introduces the large amount of fuel vaporized during refueling into the canister 13. To permit a large flow rate of fuel vapor, the cross-sectional area of the breather line 25 is ten times larger than that of the vapor line 21. One end of the breather line 25 is connected to the first space 18 defined in the canister 13, while the other end is connected to a differential pressure regulating valve 26 provided on the tank 1. The regulating valve 26 is opened only during refueling of the tank 1. The pressure valve 26 shown in FIG. 1 is enlarged in FIG. 3. As shown in FIGS. 1 and 3, the pressure valve 26 includes an outer valve 27 located on the upper surface of the tank 1, and an inner valve 28 located inside the tank 1. The pressure valve 26 also includes a cylindrical housing 26*a*, which is fixed to the tank 1 and has a closed bottom. The outer valve 27 is constituted by the portion of the housing 26*a* that is above the upper surface of the tank 1. The inner valve 28 is constituted by the remaining portion of the housing 26*a*, which is inside the tank 1.

A diaphragm 27*a* defines first and second pressure chambers 27*b*, 27*c* in the portion of the housing 26*a* that constitutes the outer valve 26. A spring 27*d* located in the first pressure chamber 27*b* urges the diaphragm 27*a* downward. The first pressure chamber 27*b* is connected to the filler pipe 2 through a pipe 29. An end of the breather line 25 is connected to the second pressure chamber 27*c*.

The inner valve 28 includes a float 28*a* accommodated in the housing 26*a* and a valve opening 28*b* provided in the housing 26*a* at a position corresponding to the float 28*a*. The valve opening 28*b* communicates the inside of the housing 26*a* and the second pressure chamber 27*c*. A plurality of holes 28*c* formed in the side wall of the housing 26*a* below the valve opening 28*b* communicate the inside of the housing 26*a* with the inside of the tank 1.

When the height of the surface of the fuel in the tank 1 becomes lower than the position of the holes 28*c*, the float 28*a*, lowered by its own weight, opens the valve opening 28*b*. When the height of the fuel surface becomes higher than the position of the holes 28*c*, fuel enters the housing 26*a* through the holes 28*c*. This raises the float 28*a* and closes the valve opening 28*b*.

Accordingly, when the filler hole 2*b* of the filler pipe 2 is closed by the cap 3 and the fuel surface is lower than the holes 28*c*, the float 28*a* opens the valve opening 28*b*. When the valve opening 28*b* is opened, the internal pressure of the tank 1 acts on the first pressure chamber 27*b* of the outer valve 27 through the pipe 29. In addition, the internal pressure of the tank 1 acts on the second pressure chamber 27*c* through the holes 28*c* and the opening 28*b*. Therefore, the pressure acting on the diaphragm 27*a* in both chambers 27*b*, 27*c* is equal. This results in the diaphragm 27*a* closing an opened end 25*a* of the breather line 25.

On the other hand, when the filler hole 2*b* is opened during refueling, the atmospheric pressure acts on the first pressure chamber 27*b* of the outer valve 27 through the pipe 29. In this state, the internal pressure of the tank 1 increases when a large amount of fuel vaporizes during refueling. This imbalances the pressure of the chambers 27*b*, 27*c* and displaces the diaphragm 27*a* upward thus opening the opened end 25*a* of the breather line 25. As a result, the large amount of vaporized fuel in the tank 1 is sent to the canister 13 through the breather line 25. Afterward, the height of the fuel surface in the tank 1 rises and causes the float 28*a* to close the valve opening 28*b*. This displaces the diaphragm 27*a* downward with the force of the spring 27*d* and closes the opened end 25*a* of the breather line 25.

As described above, fuel-vapor is drawn into the canister 13 through the vapor line 21 and the breather line 25. The fuel-vapor is then adsorbed by the adsorbent 14 in the canister 13. The adsorbed fuel is supplied to the intake passage 11 as necessary. The fuel is then drawn into each cylinder of the engine 9 for combustion.

A purge line 30, extending from the first space 18 of the canister 13, is connected to the surge tank 31 in the intake passage 11. The purge line 30 includes a purge control valve 32. The purge control valve 32 is duty controlled, thereby adjusting the flow rate of the fuel through the valve 32. Opening the valve 32 during operation of the engine 9 allows the negative pressure in the surge tank 31 to act on the first space 18 of the canister 13 via the purge line 30. This draws fuel-vapor adsorbed in the adsorbent 14 into the surge tank 31 from the canister 13 via the purge line 30. The fuel is then drawn into the engine 9 for combustion.

Figure 2:
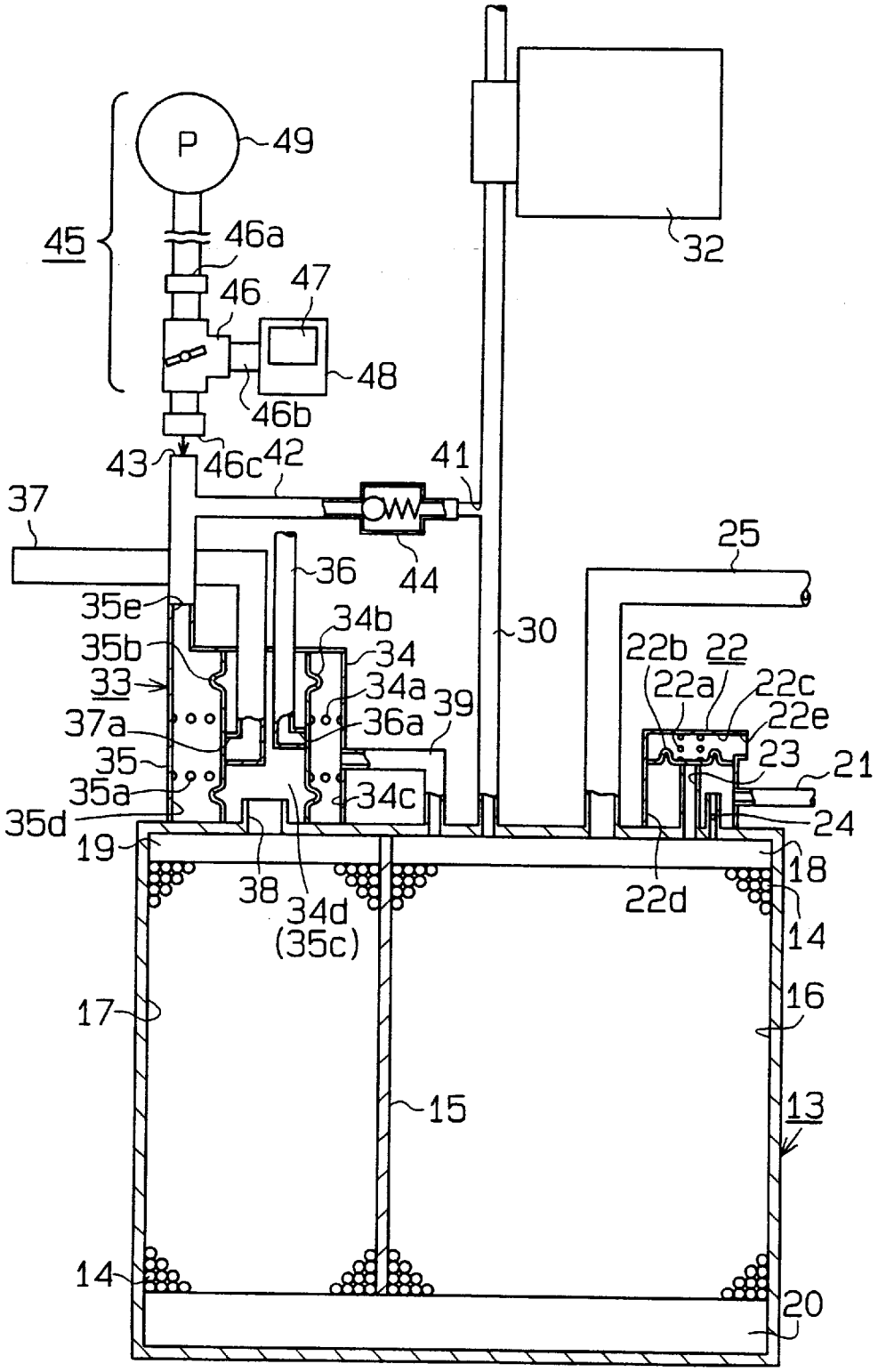
FIG. 2 is an enlarged cross-sectional view showing a canister and devices in the vicinity of the canister of FIG. 1.
Figure 3:
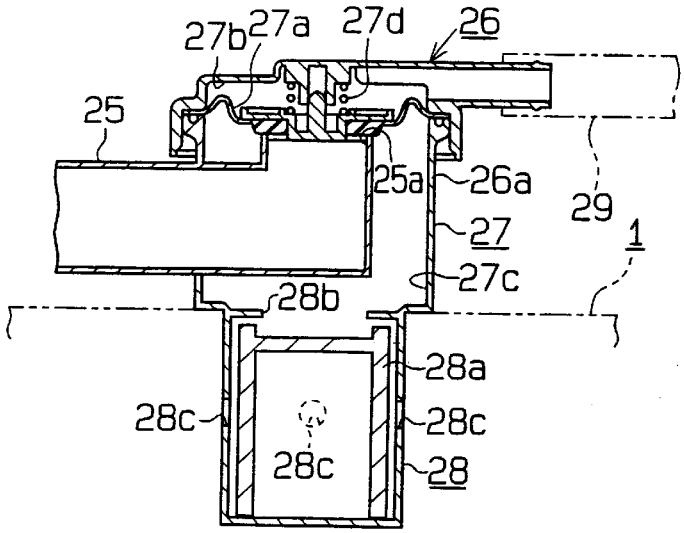
FIG. 3 is an enlarged cross-sectional view showing a differential pressure regulating valve of the apparatus of FIG. 1.
Figure 4:
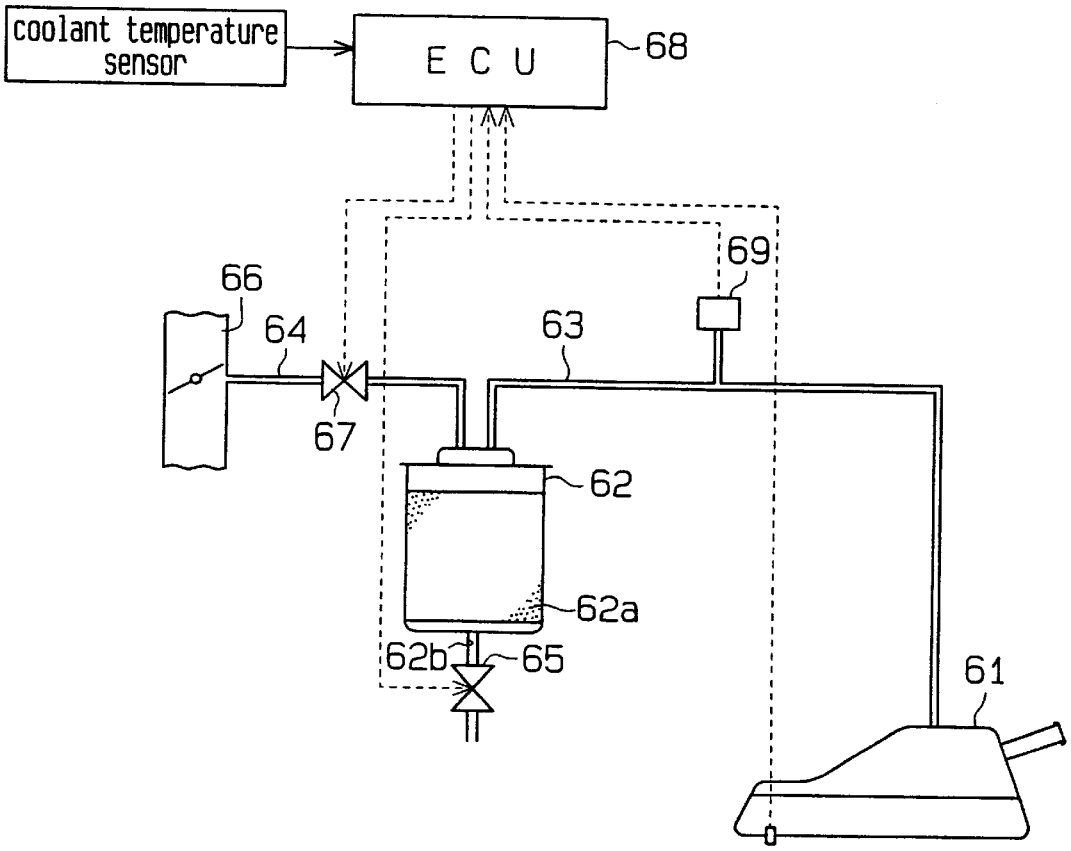
Fig.4 (PRIOR ART)
FIG. 4 is a schematic view showing a testing system for the prior art fuel vapor treating apparatus.

As shown in FIGS. 1 and 2, a valve mechanism 33, which corresponds to the second space 19, is provided on the canister 13. The valve mechanism 33 is opened based on changes of the internal pressure of the canister 13. The is mechanism 23 includes first and second atmospheric valves 34, 35 and pipes 36, 37 that correspond to the valves 34, 35, respectively. The valves 34, 35 are diaphragm type check valves. The first atmospheric valve 34 is opened for communicating the atmospheric pressure to the canister 13, while the second atmospheric valve 35 is opened for releasing air to the outside from the canister 13.

When fuel-vapor is drawn to the purge line 30 from the canister 13, the first atmospheric valve 34 is opened by the negative pressure acting on the canister 13 via the purge line 30. This communicates the outside atmospheric pressure to the canister 13. As shown in FIG. 2, the first atmospheric valve 34 corresponds to an atmospheric hole 38 formed in the second space 19 of the canister 13. The first atmospheric valve 34 includes a diaphragm 34*b* contacting an opening 36*a* of the pipe 36. The diaphragm 34*b* defines first and second pressure chambers 34*c*, 34*d*. A spring 34*a* extends in the first pressure chamber 34*c* and urges the diaphragm 34*b* toward the opening 36*a*. The first pressure chamber 34*c* is communicated with the first space 18 of the canister 13 by a communication passage 39. The second pressure chamber 34*d* is communicated with the second space 19 by the atmospheric hole 38.

When equal to or lower than a predetermined level that is lower than the atmospheric pressure, the internal pressure of the canister 13 acts on the diaphragm 34*b* via the communication passage 39 and the first pressure chamber 34*c*. This displaces the diaphragm 34*b* away from the opening 36*a* of the pipe 36 against the force of the spring 34*a*, thereby opening the opening 36*a*. Accordingly, the atmospheric air is drawn into the canister 13 from the pipe 36 via the atmospheric hole 38. This allows the fuel-vapor in the canister 13 to flow to the intake passage 11.

When the pressure in the canister 13 is equal to or higher than a predetermined level that is higher than the atmospheric pressure, the second atmospheric valve 35 is opened for allowing air flow to the outside from the canister 13 via the atmospheric hole 38 and the pipe 37. As shown in FIG. 2, the second atmospheric valve 35 corresponds to the atmospheric hole 38 in the canister 13. The second atmospheric valve 35 includes a diaphragm 35*b* contacting an opening 37*a* of the pipe 37. The diaphragm 35*b* defines first and second pressure chambers 35*c*, 35*d*. A spring 35*a* extends in the second pressure chamber 35*d* and urges the diaphragm 35*b* toward the opening 37*a*. The second pressure chamber 35*d* is provided with a first pressure port 35*e* for introducing a predetermined pressure. The first pressure chamber 35*c*, which also functions as the second pressure chamber 34*d* of the first atmospheric valve 34, is communicated with the second space 19 of the canister 13 by the atmospheric hole 38.

When equal to or higher than a predetermined level that is higher than the atmospheric pressure, the internal pressure of the canister 13 acts on the diaphragm 35*b* via the atmospheric hole 38. This displaces the diaphragm 35*b* away from the opening 37*a* of the pipe 37 against the force of the spring 35*a*, thereby opening the opening 37*a*. This allows air to flow from the canister 13 to the pipe 37. The air flow consists of clear gas, or gas from which fuel was removed by the adsorbent 14, through the pipe 37.

A closed space including the tank 1, the canister 13, the vapor line 21, the breather line 25 and the purge line 30 is defined in the fuel-vapor treating apparatus. The apparatus has a construction for easily testing the sealing of the closed space. In this simplified testing, pressure of a predetermined level is communicated to the closed space. Changes in the communicated pressure in the closed space are monitored for testing the sealing of the closed space. If the pressure in the space abruptly drops, the space is not properly sealed. Accordingly, the apparatus is diagnosed to have a sealing malfunction.

As shown in FIGS. 1 and 2, the construction for the simplified testing includes the first pressure port 35*e* formed in the second atmospheric valve 35, a second pressure port 41 provided in the purge line 30 and a service pipe 42, which connects the port 35*e* with the port 41. The service pipe 42 includes an introduction port 43 for introducing positive pressure for the testing. A check valve 44 is located in the service pipe 42 between the introduction port 43 and the second pressure port 41. The check valve 44 controls air flow in the pipe 42. Specifically, the valve 44 communicates the pressure for the testing introduced from the port 43 to the second pressure port 41 and prevents the pressure acting on the second pressure port 41 from being released through the introduction port 43. The service pipe 42 is manufactured with the check valve 44 embedded therein. The introduction port 43 is located in the engine room of the vehicle.

The pressure required for opening the check valve 44 is lower than the pressure for the testing. When fuel is supplied to the surge tank 31 via the purge line 30, the check valve 44 is not opened by the pressure in the purge line 30. Further, when the purge control valve 32 is duty controlled, the valve 44 is not opened by pressure pulsation in the purge line 30. The pressure for the testing is higher than the pressure required for opening the relief valve 24 in the vapor control valve 22.

A testing device 45 illustrated in FIG. 2 is employed for the simplified testing for the sealing of the fuel-vapor treating apparatus. As shown in FIG. 2, the device 45 includes a pressure sensor 48 and a pressure pump 49. The pressure sensor 48 includes a cross valve 46 and a display 47. The pressure pump 49 produces positive pressure for the testing. The cross valve 46 has first, second and third ports 46*a*, 46*b* and 46*c*. The first port 46*a* is connected to the pump 49. The second port 46*b* is connected to the pressure sensor 48. The third port 46*c* is connectable to the introduction port 43. The third port 46*c* is selectively communicated with the pressure sensor 48 and the pressure pump 49 by controlling the cross valve 46.

A simplified test for testing the integrity of the sealing of the space defined by the parts 1, 13, 21, 25, 30 is performed in a manner described below.

The engine room is opened when the engine 9 is not running and the purge control valve 32 is closed. The third port 46*c* of the cross valve 46 is connected to the introduction port 43. The check valve 46 is controlled for communicating the third port 46*c* with the pressure pump 49.

The pressure pump 49 is then actuated. This produces pressure for the test and communicates the pressure to the service pipe 42 through the introduction port 43. The testing pressure opens the check valve 44 and is communicated to the inside of the canister 13 through the second pressure port 41 and the purge line 30. The testing pressure communicated to the canister 13 opens the relief valve 24 and is communicated to the tank 1 through the vapor line 21. The testing pressure in the canister 13 is also introduced to the breather line 25. In this manner, the testing pressure is communicated to the space defined by the parts 1, 13, 21, 24, 30. At the same time, the testing pressure is communicated to the second pressure chamber 35*d* of the second atmospheric valve 35 through the first pressure port 35*e*.

Accordingly, the pressure acting on both sides of the diaphragm 35*b* of the second atmospheric valve 35 are equalized. Therefore, the diaphragm 35*b* is urged by the spring 35*a* and closes the opening 37*a* of the pipe 37. In this manner, when the testing pressure (positive pressure) is communicated to the inside of the canister 13, the second atmospheric valve 35 is forced to close. Thus, if there are no punctures in the closed space, change in the testing pressure communicated to the closed space is gradual.

After completion of communicating the testing pressure to the closed space, the third port 46*c* is communicated with the pressure sensor 48 by controlling the cross valve 46. Changes of pressure on the display 47 are monitored to judge whether the seal integrity of the closed space is maintained. Specifically, if the pressure on the display 47 gradually lowers, it is judged that proper sealing is maintained. If the pressure on the display 47 abruptly drops, it is judged that the seal has been broken.

The above described simplified testing is performed in a short length of time, namely approximately in thirty seconds.

The second atmospheric valve 35 is normally opened based on increase in the internal pressure of the canister 13. However, when the positive testing pressure is communicated to the closed space in the apparatus through the introduction port 43, the second atmospheric valve 35 is securely closed. Thus, the seal test for the closed space is accurately and easily performed based on the testing pressure.

When the testing is finished, the third port 46*c* of the cross valve 46 is detached from the introduction port 43. Accordingly, the introduction port 43 is exposed to the atmosphere. In this state, the check valve 44 disconnects the second pressure port 41 from the introduction port 43.

When the testing is not being performed, the check valve 44 is closed. Therefore, when fuel is supplied to the surge tank 31 from the canister 13 through the purge line 30, the fuel passing through the purge line 30 does not leak to the outside from the introduction port 43.

The above described simplified testing requires no additional actuator such as a vacuum switching valve for defining a closed space when testing the seal integrity of the apparatus. This simplifies the construction of the fuel-vapor treating apparatus and reduces the cost.

The present invention may be further embodied as follows.

The service pipe 42, which includes the introduction port 43 and the check valve 44, may be omitted. In this case, the first pressure port 35*e* and the second pressure port 41 function as introduction ports. When performing the seal test, testing pressure is introduced from both ports 35*e* and 41 to the closed space. When testing is not being performed, the second pressure port 41 is sealed with a cap.

The service pipe 42, which includes the introduction port 43 and the check valve 44, may be detachable. In this case, the service pipe 42 is attached to the apparatus only when the testing is being performed.

The present invention may be embodied in a fuel-vapor treating apparatus that does not have the breather line 25 and differential pressure regulating valve 26.

Therefore, the present examples and embodiments are to be considered as illustrative and not restrictive and the invention is not to be limited to the details given herein, but may be modified within the scope and equivalence of the appended claims.

What is claimed is:

1. An apparatus for treating fuel vapor from a fuel tank that stores fuel to be supplied to an intake passage of an engine, wherein said apparatus includes a canister for collecting the fuel vapor generated in the fuel tank through a vapor line, a purge line for purging the collected fuel in the canister into the intake passage by a negative intake pressure generated in the intake passage during operation of the engine, and a control valve disposed on the purge line to selectively open and close the purge line, wherein said fuel tank, said canister, said vapor line and said purge line are connectable to one another to define a closed space, wherein the sealing of the closed space is tested based on variation of the pressure in the closed space after pressure for testing is introduced into the closed space, said apparatus comprising:

an atmospheric valve for connecting said canister with the atmosphere based on variation of the pressure in the canister, said atmospheric valve having a diaphragm, a first pressure chamber and a second pressure chamber, the first and second pressure chambers being separated by the diaphragm, wherein the pressure in the canister is introduced into said first pressure chamber, and including a first pressure port communicating with said second pressure chamber and adapted to communicate with the atmosphere;

said purge line having a second pressure port defined between the canister and the control valve, said second pressure port being openable solely during testing of the sealing of the closed space; and the pressure for the testing is introduced from said first pressure port and said second pressure port when the test is performed.

2. The apparatus according to claim 1 further comprising:

a pipe for connecting said first pressure port with said second pressure port, said pipe having a single introduction port for introducing the pressure for the testing; and a check valve located in the pipe between said introduction port and said second pressure port, wherein said check valve allows the pressure for the testing introduced from the introduction port to be supplied to the second pressure port and prevents the pressure acting on the second pressure port from being released through the introduction port.

3. The apparatus according to claim 1, wherein said pressure for the testing is positive pressure that is higher than atmospheric pressure.

4. The apparatus according to claim 3, wherein said canister has an atmospheric hole communicating with said first pressure chamber, wherein said atmospheric valve includes a passage, said passage having a first opening communicating with the atmosphere and a second opening placed in the first pressure chamber, wherein said diaphragm opens said second opening to allow the flow of the gas from canister to the passage when the pressure introduced into the first pressure chamber from the canister through the atmospheric hole is higher than the pressure in the second pressure chamber by a predetermined value.

5. The apparatus according to claim 2 further comprising a testing device for testing the sealing of the closed space, wherein said testing device includes:

a three-way valve having a first port, a second port and a third port, said three-way valve selectively connecting the third port with one of the first port and the second port;

a pump connected with the first port to supply the pressure for the testing to the closed space;

a pressure sensor connected with the second port to detect the pressure in the closed space; and said third port being connectable with said introduction port.

6. The apparatus according to claim 1 further comprising a breather line for introducing vaporized fuel in the tank into the canister during refueling, said breather line having a diameter greater than that of the vapor line.

7. The apparatus according to claim 6 further comprising a valve for allowing the vaporized fuel to flow into the canister through the breather line during refueling, wherein said valve is open based on a difference between the atmospheric pressure and the pressure in the tank.

8. An apparatus for treating fuel vapor from a fuel tank that stores fuel to be supplied to an intake passage of an engine, wherein said apparatus includes a canister for collecting the fuel vapor generated in the fuel tank through a vapor line, a purge line for purging the collected fuel in the canister into the intake passage by a negative intake pressure generated in the intake passage during operation of the engine, and a control valve disposed on the purge line to selectively open and close the purge line, wherein said fuel tank, said canister, said vapor line and said purge line are connectable to one another to define a closed space, wherein a testing device separately provided from the apparatus tests the sealing of the closed space based on variation of the pressure in the closed space after pressure for testing is introduced into the closed space from the testing device, said apparatus comprising:

an atmospheric valve for connecting said canister with the atmosphere based on the variation of the pressure in the canister, said atmospheric valve having a diaphragm, a first pressure chamber and a second pressure chamber, the first and second pressure chambers being separated by the diaphragm, wherein the pressure in the canister is introduced into said first pressure chamber, and including a first pressure port communicating with said second pressure chamber;

said purge line having a second pressure port defined between the canister and the control valve;

a pipe for connecting said first pressure port with said second pressure port, said pipe having a single introduction port which communicates with the atmosphere when the testing is not performed and is connected to said testing device to introduce the pressure for the testing when the test is performed; and a check valve located in the pipe between said introduction port and said second pressure part, wherein said check valve allows the pressure for the testing introduced from the introduction port to be supplied to the second pressure port and prevents the pressure acting on the second pressure port from being released through the introduction port.

9. The apparatus according to claim 8, wherein said pressure for the testing is positive pressure that is higher than atmospheric pressure.

10. The apparatus according to claim 9, wherein said canister has an atmospheric hole communicating with said first pressure chamber, wherein said atmospheric valve includes a passage, said passage having a first opening communicating with the atmosphere and a second opening located in the first pressure chamber, wherein said diaphragm opens said second opening to allow gas to flow from the canister to the passage when the pressure introduced into the first pressure chamber from the canister through the atmospheric hole is higher than the pressure in the second pressure chamber by a predetermined value.

11. The apparatus according to claim 8, wherein said testing device includes:

a three-way valve having a first port, a second port and a third port, said three-way valve selectively connecting the third port with one of the first port and the second port;

a pump connected with the first port to supply the pressure for the testing to the closed space;

a pressure sensor connected with the second part to detect the pressure in the closed space; and said third port being connectable with said introduction port.

12. The apparatus according to claim 8 further comprising a breather line for introducing vaporized fuel in the tank into the canister during refueling, said breather line having a diameter greater than that of the vapor line.

13. The apparatus according to claim 12 further comprising a valve for allowing the vaporized fuel to flow into the canister through the breather line during refueling, wherein said valve is open based on a difference between the atmospheric pressure and the pressure in the tank.

* * * * *